US009713934B2

(12) United States Patent
Frison

(10) Patent No.: US 9,713,934 B2
(45) Date of Patent: Jul. 25, 2017

(54) PHOTOGRAPH ALBUM

(71) Applicant: ITALIAN CREATIVE BOOK SRL, Fanna (IT)

(72) Inventor: Tiziano Frison, Fanna (IT)

(73) Assignee: ITALIAN CREATIVE BOOK SRL, Fanna (IT)

( * ) Notice: Subject to any disclaimer, the term of this patent is extended or adjusted under 35 U.S.C. 154(b) by 0 days.

(21) Appl. No.: 14/374,029

(22) PCT Filed: Jan. 25, 2013

(86) PCT No.: PCT/IB2013/000085
§ 371 (c)(1),
(2) Date: Jul. 23, 2014

(87) PCT Pub. No.: WO2013/111000
PCT Pub. Date: Aug. 1, 2013

(65) Prior Publication Data

US 2014/0361524 A1 Dec. 11, 2014

(30) Foreign Application Priority Data

Jan. 26, 2012 (IT) ..... UD2012A0010

(51) Int. Cl.
*B42D 1/02* (2006.01)
*B42D 1/06* (2006.01)
(Continued)

(52) U.S. Cl.
CPC ..... *B42D 1/08* (2013.01); *B42C 11/04* (2013.01); *B42D 1/006* (2013.01); *B42D 1/02* (2013.01); *B42D 1/06* (2013.01)

(58) Field of Classification Search
CPC ..... B42D 1/02; B42D 1/06; B42D 1/006
(Continued)

(56) References Cited

U.S. PATENT DOCUMENTS 1,992,618 A * 2/1935 Jeffreys ..... 281/21.1
2,155,327 A * 4/1939 Oppermann ..... 281/5
(Continued)

FOREIGN PATENT DOCUMENTS

CH 365702 A * 11/1962 ..... B42D 3/002
JP 2002321466 A 11/2002

OTHER PUBLICATIONS

PCT Search Report dated May 8, 2013 of Patent Application No. PCT/IB2013/00085 filed Jan. 25, 2013.

*Primary Examiner* — Kyle Grabowski
(74) *Attorney, Agent, or Firm* — Maine Cernota & Rardin

(57) ABSTRACT

A photograph album (10) with a square spine comprises a cover (12) having a first sheet (17), a second sheet (18), and a central square spine (19) which connects the first sheet (17) to the second sheet, and a plurality of pages (13, 14, 15) bound reciprocally in correspondence to a first side (16*a*) to define a book body (11), characterized in that the last of said pages (14) is partly connected to the internal surface of said second sheet (18), having a first surface portion (21) solidly associated to the internal surface of said second sheet (18), to define the only connection between said cover (12) and said book body (11), and a second surface portion (22) free and not connected to the internal surface of said second sheet (18), said first surface portion (21) being a part of the last of said pages (14) disposed in proximity to a second side (16*b*) of said last page (14), opposite said first side (16*a*).

9 Claims, 4 Drawing Sheets

(51) Int. Cl.

| | |
|---|---|
| ***B42D 1/08*** | (2006.01) |
| ***B42D 1/00*** | (2006.01) |
| ***B42C 11/04*** | (2006.01) |

(58) Field of Classification Search
USPC ..... 281/5, 22–23, 21.1, 40
See application file for complete search history.

(56) References Cited

U.S. PATENT DOCUMENTS

| | | | | |
|---|---|---|---|---|
| 3,189,369 | A * | 6/1965 | Walker, Jr. | 281/33 |
| 3,738,686 | A * | 6/1973 | Morse | 283/63.1 |
| 2007/0085321 | A1* | 4/2007 | Huang | 281/3.1 |
| 2007/0226069 | A1 | 9/2007 | Sanchez et al. | |
| 2009/0218804 | A1 | 9/2009 | Wang | |
| 2009/0284002 | A1* | 11/2009 | Miranti | B42F 7/06 281/22 |

* cited by examiner

PHOTOGRAPH ALBUM

RELATED APPLICATIONS

This application is a national phase application of PCT Application No. PCT/IB2013/000085 filed on Jan. 25, 2013, which claims priority from Italian Application No. UD2-12A000010 filed on Jan. 26, 2012. Each of these applications is herein incorporated by reference in their entirety for all purposes.

FIELD OF THE INVENTION

The present invention concerns a photograph album to collect images or graphic representations of public or private events, as well as company presentations. The photograph album can contain photographs, postcards, souvenir autographs, pictures of people, for example members of a family at various moments of their lives, but also of animals, objects, scenery or other. In particular, the photograph album according to the present invention comprises a plurality of pages, made of stiff or semi-stiff cardboard, on which photographs or printed graphic representations of the above type are directly printed or are stably disposed or applied.

BACKGROUND OF THE INVENTION

Photograph albums are known, comprising a main book body provided with a plurality of pages made of stiff or semi-stiff cardboard on each of which a photograph has been previously printed, or alternatively a photograph or a print is subsequently associated.

A substantially stiff cover is associated to the book body and comprises a first external sheet, also called front plate in bookbinding, formed by the front cover and the inside front cover which, in the closed condition, covers the first page of the book body, a second external sheet, also called back plate in bookbinding, formed by the inside back cover and the back cover, associated with the last page of the book body and a central spine, substantially free, which provides only to reciprocally connect the first external sheet and the second external sheet. The spine of the cover can either be made in a material as stiff as the first and the second sheet (square spine) or more flexible with respect to the first and the second sheet (round spine) and when this second form of embodiment is used, it can have a rounded shape around the thickness of the book body.

If the album is bound with a square spine, given that the book block is formed by coupled pages, the total opening of the volume is not optimal both from an esthetic viewpoint and because the album itself deteriorates rapidly, in that the forces at play, proportional to the thickness of the album, cause bulgings which emerge in proximity to the center line of the book body as the thickness of the book block increases.

Because of these problems this type of solution can be used only on book blocks with a limited thickness.

If the album is bound with a rounded spine, the central spine which is flexible and rounded, once the book body is associated to the cover, allows to easily turn its pages, preventing bulging in proximity to the center line of the book body. The first and the last coupled four page folder are therefore shorter than the central four page folder, while all the others have a proportional length able to obtain the rounded shape of the spine. On the other hand, if the book block has a square spine and a rounded cover, there is a rapid deterioration of the spine, as well as esthetic problems.

The pages of the book body are reciprocally associated with respect to each other in contiguous pairs so that, in any condition of the book body being open, the two faces are substantially flat and defined by a single sheet on which a photograph can be previously printed. In the same way, the opposite faces of the two pages considered are part of a sheet that defines the previous and respectively successive page of the two pages considered.

The pages thus associated do not therefore need further binding operations inasmuch as they are already reciprocally joined.

One disadvantage of known photograph albums is that the spine of the cover must be made differently from the first and second page so that it can assume a curved configuration which allows to leaf through the pages avoiding problems of bulging in the center line of the book body.

Another disadvantage is that, when the pages are leafed through, the spine of the cover is deformed, causing a rapid deterioration thereof until it becomes detached from the first and second sheet of the cover.

A paperback book is also known, from document CH-A-365.702, provided with a strip of flexible and resistant material with a length equal to the height of the paperback part, and with a median part glued on the spine of the paperback part, a flyleaf glued on the entire external surface of the strip, a sheet glued inside each half of the flyleaf and on the part of the flexible strip exceeding the spine of the whole, and a cover, made in a single piece, glued only on the part of the lower half of the flyleaf glued on the flexible strip. This solution can also suffer possible deformations of the spine, and does not allow to open the book at 180° in planar fashion without damaging stresses to the material.

Purpose of the present invention is to obtain a photograph album with a square spine that has different esthetic and functional characteristics from the usual products on the market, which is easy to make, which opens in planar fashion, or flat, at 180°, and possibly even more, without triggering forces that would deteriorate the album, which represents an innovation with respect to the opening of a traditional album, which has an extended duration over time even after repeated uses, which allows innovation in terms of the product with respect to what is currently present on the market of photograph albums.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purpose, a photograph album with a square spine according to the present invention comprises a cover and a book body defined by a plurality of pages reciprocally bound with respect to each other in a binding direction and made of stiff or semi-stiff cardboard.

The cover comprises a first sheet, or front plate, which has a front cover and an inside front cover, a second sheet or back plate, which has an inside back cover and a back cover, and a central square spine which develops along the binding direction and which connects the first sheet to the second sheet. The pages reciprocally are bound in correspondence to a first side so as to define the book body and have a determinate thickness to confer the desired rigidity to the page by virtue of the material of which they are made.

According to one feature of the present invention, the last of the pages of the book body has a first surface portion or strip, which is more distant from the central spine, solidly constrained to the inside back cover, in order to define overall the sole reciprocal connection between the cover and the book body. In particular, the first surface portion or strip is disposed in proximity to a second side of the last page, parallel to the binding direction, which is opposite with respect to a first side in correspondence to which the last page is bound to the other pages of the book body.

The book body is therefore associated with the cover only in proximity to a surface portion, more external with respect to the central spine, of the inside back cover. The front cover and the inside front cover and the spine, instead, are totally uncoupled from the book body and, when the album is closed, they are placed to respectively cover the first page and the thickness of the book body. In this way, as the pages are turned, a free movement of the pages already turned and of the pages to be turned is determined. The spine of the cover is therefore prevented from impeding or hindering the free rotation of the pages. With the present invention it is therefore possible to open the book at 180°, and also possibly more, in a planar fashion, or flat, without causing stresses of the material which makes up the album and preventing deformations of the spine of the cover.

In accordance with another feature of the present invention, the first surface portion of the last page of the book body extends parallel to the extension of the spine of the cover and for the entire length of the corresponding second side. In this way, a longitudinal strip is determined in proximity to the second side of the last page in which the book body is associated with the inside back cover.

According to one form of embodiment of the invention, the last page is defined by said first surface portion and by a second surface portion contiguous to the first side. Moreover, between the first portion and the second portion a line of intended folding is made, made for example by pre-creasing or similar working, which allows the last page to adapt to the movements to which the rest of the book body is subjected as the pages are turned.

According to another feature of the invention, the first surface portion extends transversely to the first side of the last page, for a length, the ratio of which, with respect to the overall width of the last page, is comprised between 0.5 and 0.75, in proportion to the thickness of the spine. In accordance with another feature of the present invention, each of the pages of the book body comprises two four page folders coupled with each other in correspondence to their respective faces. The other halves of the four page folders considered in their turn constitute respective faces of the page which precedes and follows the page in question. In this way, the pages are reciprocally coupled with each other without requiring the use of particular bindings. Moreover, when the album is open, the contiguous faces of two consecutive pages are substantially in a single body, being defined by the four page folders and thus allow, for example, to print a photograph on both the faces.

According to a variant, between the two four page folders of one page a two sided sheet is interposed, which gives the page greater rigidity. The two sided sheet, slightly shorter than the four page folders on the spine, by about 1 mm for example, carries out the function of improving and further facilitating the opening of the pages, even by more than 180°. It also allows to be able to cross the fibers of the paper, which is one-directional and hygroscopic, in order to neutralize the possible alterations of the planarity of the pages due to sudden and great variations in the humidity in the air or to the possible use of glues containing water. This allows, for gluing the four page folders, to use natural glues, of animal or vegetable origin, conferring greater rigidity on the page.

The present invention also concerns a method to make a photograph album with a square spine comprising the making of a cover with a first sheet and a second sheet which are connected by a square central spine and the making of a book body by means of a plurality of pages reciprocally bound in correspondence to a first side thereof. The method provides to partly connect the last of the pages to the internal surface of the second sheet, solidly associating a first surface portion of the last of the pages to the internal surface of the second sheet, in order to define the sole connection between the cover and the book body, and keeping a second surface portion of the last of the pages free and unconnected to the internal surface of the second sheet, the first surface portion being a part of the last of the pages disposed in proximity to a second side of the last page, opposite the first side.

BRIEF DESCRIPTION OF THE DRAWINGS

These and other characteristics of the present invention will become apparent from the following description of some forms of embodiment, given as a non-restrictive example with reference to the attached drawings wherein.

To facilitate comprehension, the same reference numbers have been used, where possible, to identify identical common elements in the drawings.

DETAILED DESCRIPTION

Figure 1:
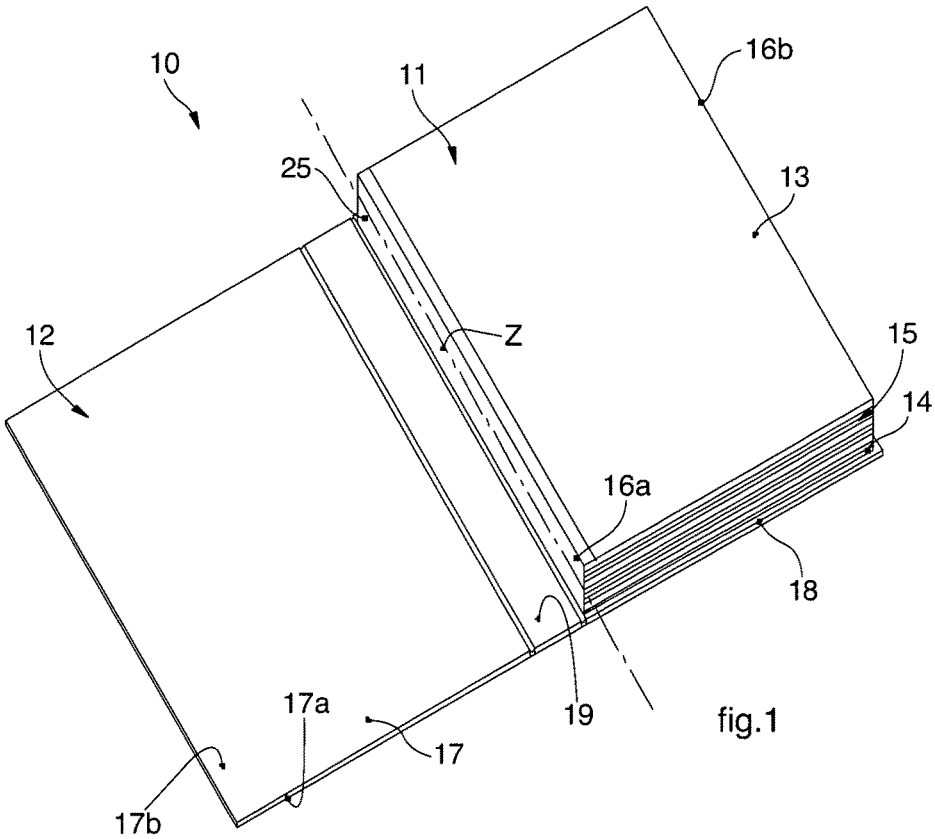
FIG. 1 is a perspective view of a photograph album according to the present invention in a first condition.
Figure 2:
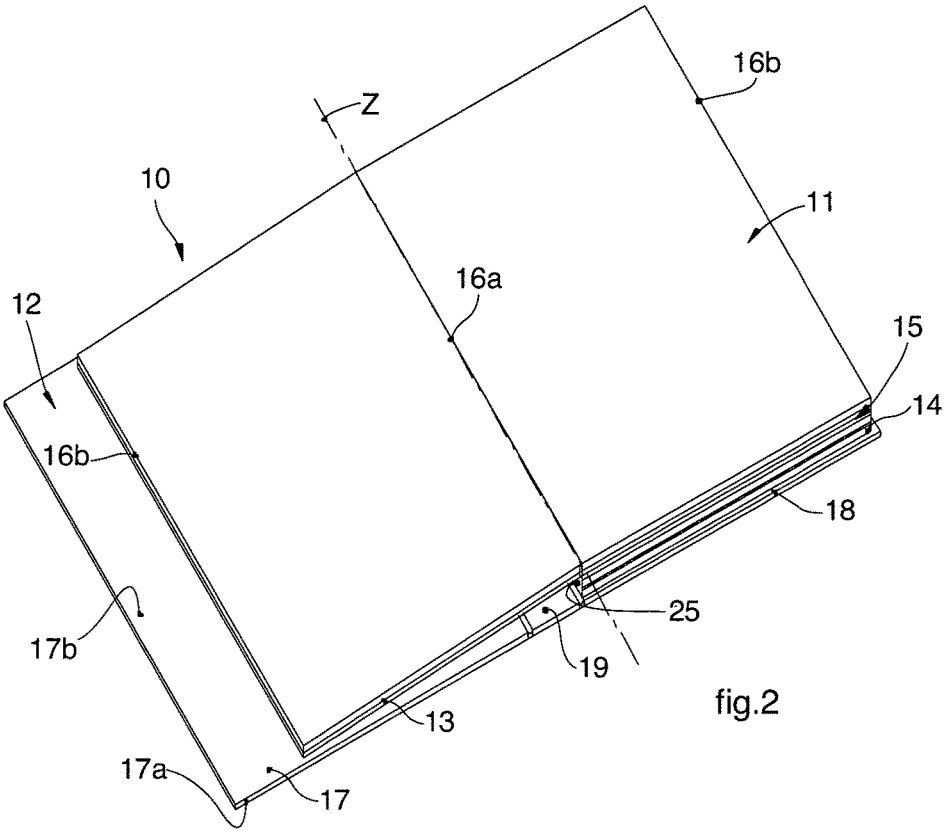
FIG. 2 is a perspective view of FIG. 1 in a second condition.
Figure 3:
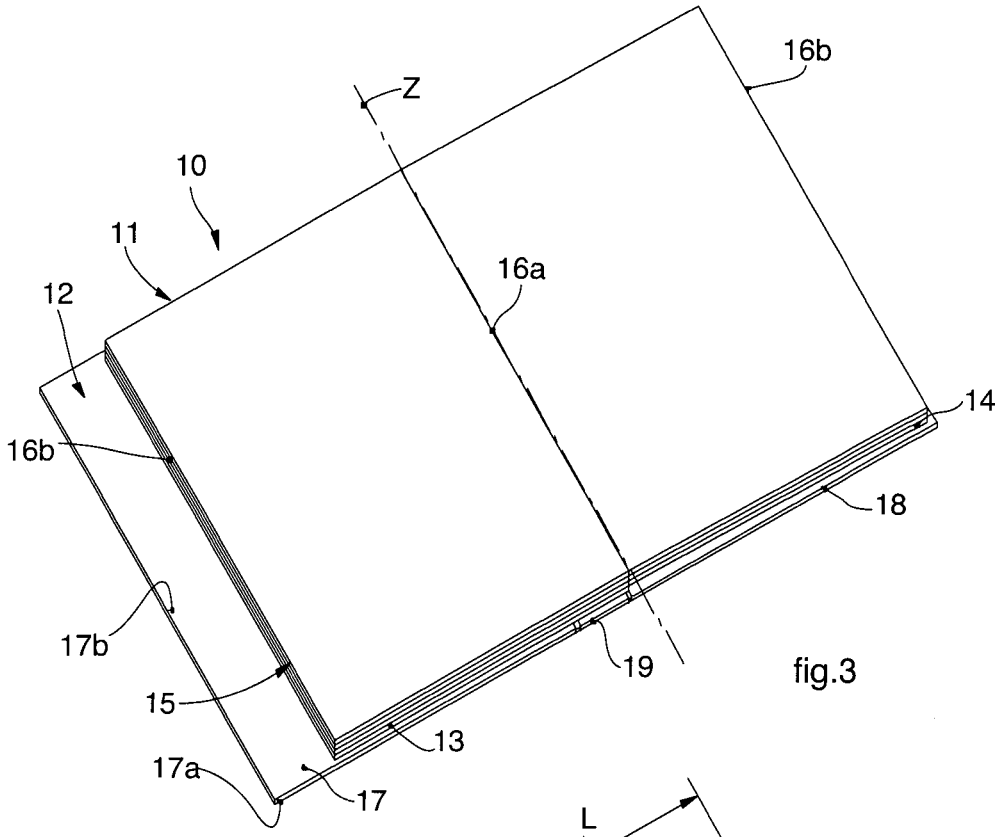
FIG. 3 is a perspective view of FIG. 1 in a third condition.

With reference to FIGS. 1-4, a photograph album with a square spine is indicated in its entirely by the reference number 10 and comprises a book body 11 which is associated, as will be described hereafter, with a cover 12.

The book body 11 is formed by pages 13, 14, 15 bound with respect to each other along a binding direction Z, around which the pages are pivoted, in order to turn the pages and leaf through the album 10. In particular the book body 11 is provided with a first page 13 and a last page 14 between which a plurality of further intermediate pages 15 are interposed.

The first page 13, the last page 14 and the intermediate pages 15 are made of stiff or semi-stiff cardboard and are reciprocally joined to each other in proximity to a first side 16*a* thereof, parallel to the binding direction Z, to define the book body 11.

The pages 13, 14 and 15 also have a second side 16*b* which is opposite and parallel to the first side 16*a*.

Figure 5:
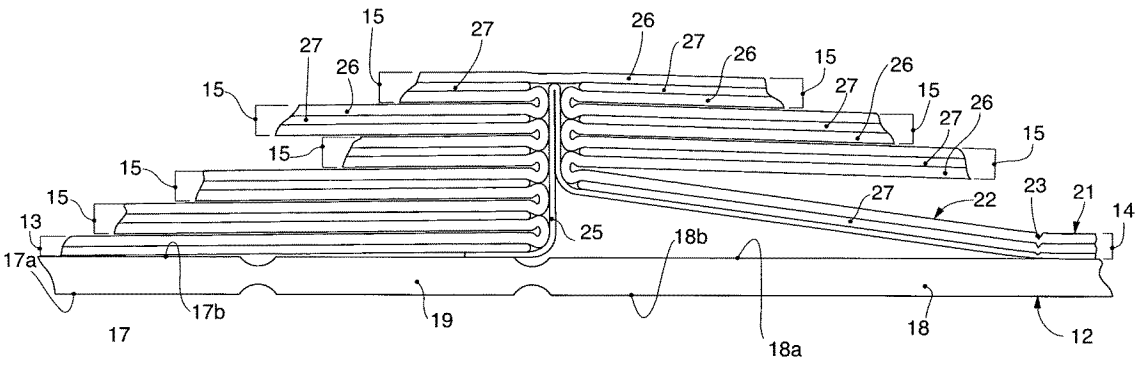
FIG. 5 is a front view of a detail in FIG. 3.

The cover 12 (FIG. 5) comprises a first sheet, or front plate 17, formed by a front cover and inside front cover 17*a*, 17*b* respectively, a second sheet or back plate 18, formed by an inside back cover and a back cover 18*a*, 18*b* respectively, and a square central spine 19 interposed between the front plate 17 and the back plate 18 and with a width substantially equal to the thickness of the book body 11, greater than the thickness of the two front and back plates 17 and 18.

The front plate 17, the back plate 18 and the spine 19, in this case, have a thickness and therefore a rigidity that are greater than the pages 13, 14, 15.

The front plate 17, the back plate 18 and the spine 19 are reciprocally connected to each other, in a known way, in order to fold them reciprocally.

For example, in some forms of embodiment, the front plate 17, back plate 18 and spine 19 connected to each other to form the cover 12, can be made of different material and/or thicknesses, from cardboard to wood, metal, plastic, for example held together by an external cover which can be partial or total, and by a possible internal covering, also partial or total, so as to join the front plate 17, back plate 18 and spine 19 and create a single component with two articulations, in correspondence to the discontinuities, which defines the cover 12. In other words the spine 19 can be articulated between front plate 17 and back plate 18.

The last page 14 (FIG. 4) of the book body 11 comprises a first surface portion 21 and a second surface portion 22. The first surface portion 21 is a part of the last page 14, it is at a greater distance from the first side 16*a*, with respect to the second surface portion 22, and is disposed in proximity to the second side 16*b*. In particular, the first surface portion 21 affects a longitudinal strip which extends for a length equal to the length of the second side 16*b*.

The first surface portion 21 is solidly attached to the inside back cover 18*a* of the back plate 18 of the cover 12, typically using glue for example. In this way, the last page 14 is only partly connected to the back plate 18 by means of the first surface portion 21, while another part of the last page 14 is unconstrained or free from the back plate 18.

In particular, a second surface portion 22 of the last page 14 and adjacent to the first side 16*a*, is instead uncoupled, or free from and not connected to the back plate 18 of the cover 12.

Between the first 21 and the second surface portion 22 a line of intended folding 23 is made (FIGS. 4 and 5), obtained for example by means of pre-creasing or similar process, which facilitates the reciprocal folding of the first surface portion 21 with respect to the second surface portion 22.

Figure 4:
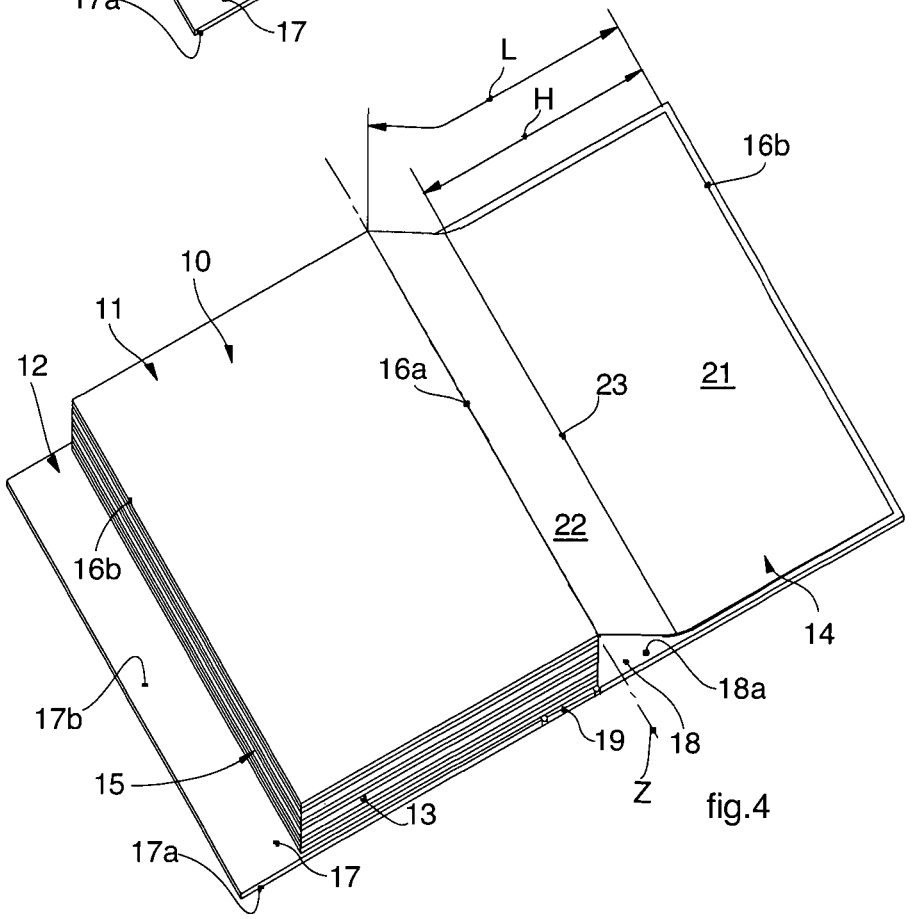
FIG. 4 is a perspective view of FIG. 1 in a fourth condition.

The last page 14, as well as the other pages 13 and 15, have a determinate width L (FIG. 4).

The first surface portion 21 of the last page 14 extends for a length H which is comprised between 0.5 and 0.75 of the width L of pages 13, 14, 15, proportionally to the thickness of the spine.

The second surface portion 22 of the last page 14 extends for a length given by the difference L-H which is comprised between 0.25 and 0.5 of the width L of the pages 13, 14, 15.

A cover element 25 is associated to the last page 14 on the side of the latter facing toward the cover 12 and for at least a surface equal to that affected by the second surface portion 22.

The cover element 25 also surrounds the thickness of the book body 11 and for a determinate segment also surrounds the first page 13.

The cover element 25 can have an esthetic and protective function, surrounding and covering the overall gluing zone of the pages, and possibly giving greater resistance to the reciprocal connection of the pages.

The cover element 25 has also an esthetic function and can use materials deriving from paper, fabric, leather or other. Each page 15 (FIG. 5) is associated solidly to the page 15 which follows and page 15 which precedes it. In particular, each page 15 comprises two four page folders 26 and a two-sided sheet 27, or central core, which is interposed and glued between the two four page folders 26. Considering one of the pages 15 of the book body 11, each four page folder 26 constitutes one side of the page 15 considered and one side of the page 15 which precedes it or which follows it, so that, when the book body 11 is open, the two consecutive pages are continuous with respect to each other and substantially flat. In substance a coupling is achieved by gluing two four page folders 26 to the two-sided sheet 27, which makes up the central core.

This particular conformation allows to print, on one side of the four page folder 26, the desired photographs or representations which, in this way, can also involve two consecutive sides of two adjacent pages without interruptions or discontinuities between one page and the other.

Moreover, in this way the effect of bulging in proximity to the intermediate zone of the book body 11 is limited, which would prevent users from seeing the prints made on the four page folder 26.

The two-sided sheet 27, which is interposed between two four page folders 26, has a width which is less than the length L of each of the pages 15 in order to facilitate the turning of the pages 15.

Each of the four page folders 26 is folded back on itself in proximity to the center line, and in particular preferential folding lines can be made, which allow to turn the pages 15 easily.

Each page 15 of the book body 11 is therefore solidly associated to the page 15 which precedes and the page 15 which follows, so that it is not necessary to provide suitable binding actions.

For the gluing operations, artificial glues may be used such as vinyl or thermofusion or polyurethaned glues or also natural glues.

In some forms of embodiment, the gluing operations between the four page folders and the two sided sheet are carried out with animal glues which quickly adapt to environmental conditions inasmuch as they contain very little water which they yield very quickly to the environment, so that a good adhesive power is almost immediate. In particular the rapid adaption to environmental conditions allows to prevent the formation of creases or undulations in the paper, in particular in the working steps as well as when using ecological glues.

This gluing technique between the four page folders 26 and the two-sided sheet 27, associated to the weave of the fibers, which are always one-directional, and which swell but do not lengthen in the presence of water, allows to guarantee a greater dimensional stability to the pages 15 compared to traditional albums, guaranteeing planarity even in adverse conditions such as sudden changes in humidity or temperature.

Merely by way of example, the first page 13, the last page 14 and the intermediate pages 15 have a thickness varying from 0.8 mm to 4 mm, preferably between 2 mm and 3 mm.

The front plate 17, the back plate 18 and the spine 19 have a thickness comprised between 2 mm and 6 mm, preferably between 3 mm and 5 mm.

The photograph album 10 according to the present invention, when it is closed, has the cover 12 which surrounds the book body 11.

When the cover 12 is open (FIG. 1), the front plate 17 and the spine 19 are disposed on the resting plane on which the album 10 is resting, given that the front plate 17 and the spine 19 are disassociated from the book body 11.

In this condition the first of said pages 15 of the book body 11 is left on view, which, because of its weight, rests on the inside back cover 18*a* of the back plate 18.

As the pages 15 are turned (FIG. 2), and as far as the center line of the book body 11, the pages 15 which have been turned rest one upon the other. Given the rigidity of the pages 15, the first of said page 15 will be disposed in contact only with its second side 16*b* against the inside front cover 17*b*.

When the center line of the book body 11 has been reached (FIG. 3), the first page 13 and the last page 14 are completely resting on the inside front cover 17*b* and the inside back cover 18*a*.

Figure 6:
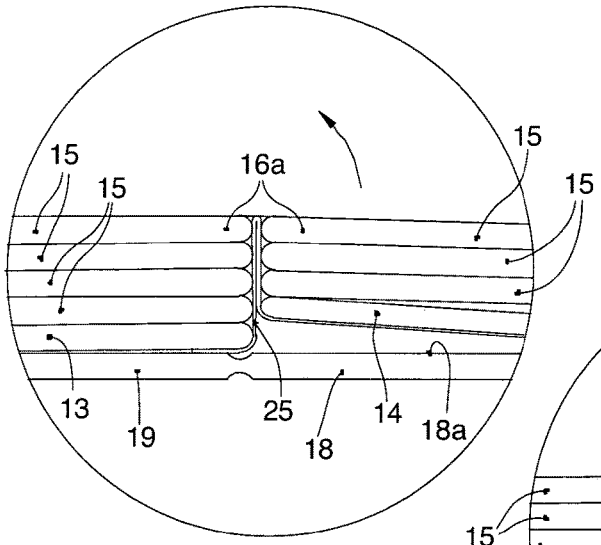
FIGS. 6-9 are schematic representations of the steps of opening a page of the album according to the present invention.

As the pages 15 continue to turn (FIG. 6), the group of pages 15 disposed upstream, that is, on the side of the front plate 17 of the cover 12, are disposed in contact due to their own weight on the inside front cover 17*b* and on the spine 19, while the group of pages 15 disposed downstream, due to their overall lesser weight, are lifted from the inside back cover 18*a* and remain resting on the latter only with the second side 16*b* of the penultimate page.

The lifting of the pages 15 disposed downstream of the book body 11 is also determined in relation to the thickness and the rigidity of the pages 15. As one page 15 is turned and disposed beyond the center line of the book body 11, the group of pages which are disposed upstream turn on the spine 19 and on the front plate 17 of the cover 12, thus allowing an easier rotation of the page.

Figure 7:
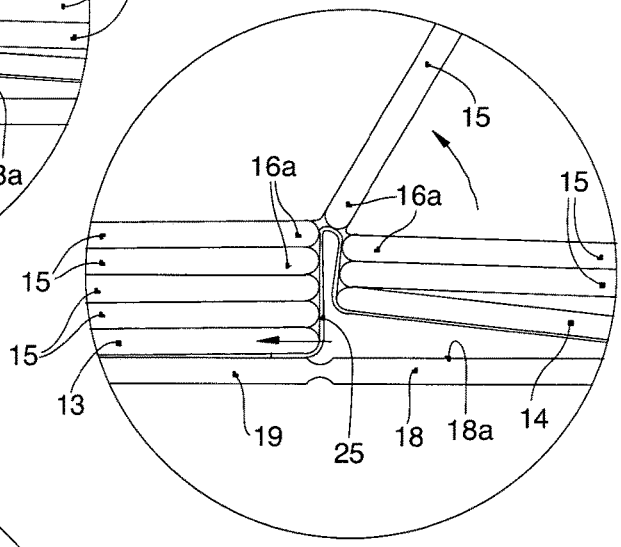
Figure 8:
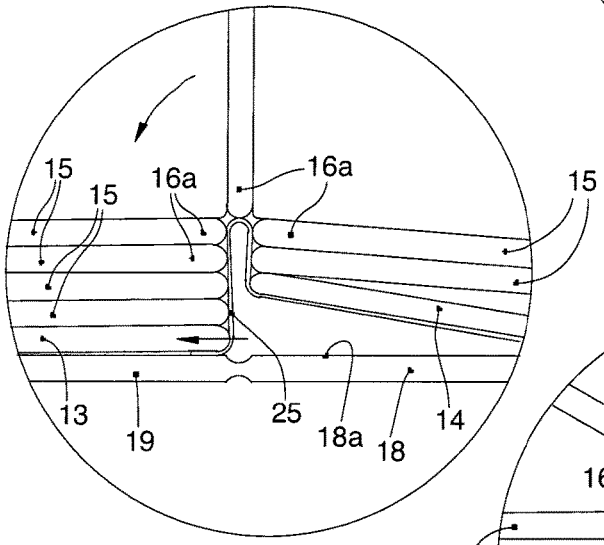

In particular, as shown in FIGS. 7 and 8, turning one page 15 disposed toward the group of pages disposed downstream determines a vertical movement of the latter, and the group of pages disposed upstream move toward the outermost edge of the front plate 17.

Figure 9:
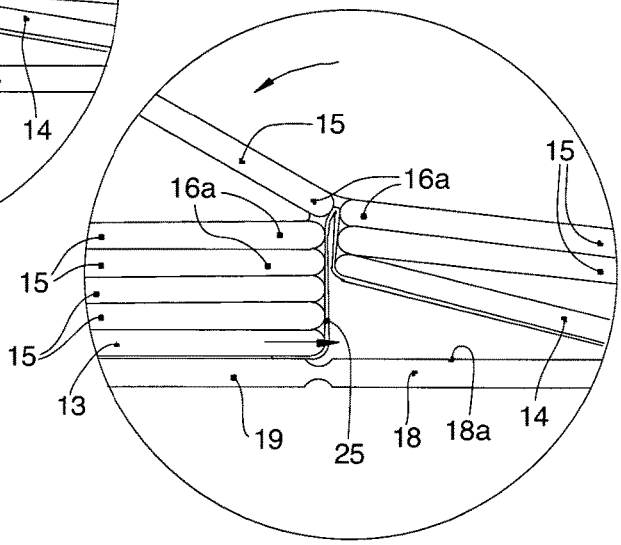

Once the page 15 (FIG. 9) has been rotated by an angle greater than 90°, an inversion is determined of the movement of the group of pages disposed upstream toward the back plate 18.

In this case therefore a vertical movement occurs of the first sides 16*a* of the group of pages 15 disposed downstream, and a transverse movement along the plane of the cover 12 of the group of pages 15 disposed upstream of the page considered.

These movements of the groups of pages are due to the fact that the last page 14 is associated to the cover only for the first surface portion 21, allowing a freedom of movement of the book body 11.

During the rotation of a page, the position of the pivoting point of the page is varied according to a circular trajectory, which therefore facilitates the movement of the pages 15.

Consequently, the present invention, having the first surface portion 21 of the last page 14 partly connected to the back plate 18, allows to open the album flatly at 180°, and possibly even more, without stresses which would damage the album, avoiding deformations of the spine. This differs from the provisions of CH-A-365,702, which as well as being a paperback book and not a photograph album with pages coupled to each other, also provides that all the surface of the part of the lower half of the flyleaf is completely glued to the cover, which prevents, therefore, opening the book flat at 180°, without causing damaging stresses, and even the breaking or detachment of the flyleaf, and which can, with use, cause deformations of the spine.

It is clear that modifications and/or additions of parts may be made to the photograph album as described heretofore, without departing from the field and scope of the present invention.

It is also clear that, although the present invention has been described with reference to some specific examples, a person of skill in the art shall certainly be able to achieve many other equivalent forms of photograph album, having the characteristics as set forth in the claims and hence all coming within the field of protection defined thereby.

The invention claimed is:

1. Photograph album with a square spine, comprising a cover having a first sheet, a second sheet, and a central flat spine having a major axis, and said central flat spine connects the first sheet to the second sheet, and a plurality of pages bound to each other along a common first side to define a book body, characterized in that said common first side of said book body being parallel to the major axis of said central flat spine;

a cover element, a portion of said cover element being disposed over said common first side of said pages and another portion of said cover element being disposed between a last page of said plurality of pages and said internal surface of said second sheet, said last page having first and second surface portions;

such that said first surface portion is affixed to the internal surface of said second sheet such that said second surface portion of said last page is free of said internal surface of said second sheet and said first surface portion is the sole connection between said book body and said cover.

2. Photograph album as in claim 1, characterized in that said first surface portion of the last page extends parallel to the major axis of said central flat spine and for the entire length of said second side when said photo album is open.

3. Photograph album as in claim 1, characterized in that the last of said pages is defined entirely by said first surface portion of said last page and by said second surface portion of said last page.

4. Photograph album as in claim 1, characterized in that a line of intended folding is made between said first surface portion of said last page and said second portion of said last page.

5. Photograph album as in claim 1, characterized in that said second portion of said last page is contiguous with said first side of said last page.

6. Photograph album as in claim 1, characterized in that the first surface portion of said last page extends transversely to the first side of said last page for a length (H), the ratio of which, with respect to the width (L) of the last page , is comprised between 0.5 and 0.75.

7. Photograph album as in claim 1, characterized in that said pages are configured from two four page folders, said folders being bound to each other along their creases.

8. Photograph album as in claim 7, characterized in that a two-sided sheet is interposed between said two four page folders.

9. Method to make a photograph album with a square spine, comprising:

making of a cover having a first sheet and a second sheet, which are connected by a central square spine, making of a book body using a plurality of pages bound together along a common first side thereof, said plurality of pages having last page, said last page having a first portion disposed away from said common first side and a second portion disposed between said first portion and said common first side, connecting a first portion of a last page of said book body to said second sheet forming said book body's only connection to said cover, such that a second portion of said last page is free of said second sheet.

* * * * *